United States Patent [19]

Fresquez et al.

[11] Patent Number: 4,711,585

[45] Date of Patent: Dec. 8, 1987

[54] CUEING AID FOR PRENATAL BREATHING CONTROL

[76] Inventors: Meredith L. Fresquez; Chris J. Fresquez, both of 1711 Wisteria La., Brea, Calif. 92621; Daniel A. Porter, 1706 Fairgreen Dr., Fullerton, Calif. 92633

[21] Appl. No.: 832,414

[22] Filed: Feb. 24, 1986

[51] Int. Cl.[4] ..... G04F 8/00; G04C 21/00

[52] U.S. Cl. ..... 368/109; 368/250; 128/28

[58] Field of Search ..... 368/107–113, 368/96, 10; 128/28, 30, 728; 364/569; 340/309.15, 309.4

[56] References Cited

U.S. PATENT DOCUMENTS

| | | | |
|---|---|---|---|
| 3,961,473 | 6/1976 | Hung | 368/96 |
| 4,147,021 | 4/1979 | Kondo | 368/251 |
| 4,491,423 | 1/1985 | Cohen | 368/107 |
| 4,493,043 | 1/1985 | Forbath | 368/251 |
| 4,589,780 | 5/1986 | Takeise | 368/248 |

*Primary Examiner*—Vit W. Miska

*Attorney, Agent, or Firm*—William L. Chapin

[57] ABSTRACT

An apparatus for providing perceptible cueing signals to an expectant mother to which she may synchronize her breathing for the purpose of easing delivery includes an oscillator of selectable frequency and duty cycle which drives physiologically perceptible transducers. In the preferred embodiment, the transducers are two different colored lamps, one of which is illuminated to cue inhalation and the other to cue exhalation. The apparatus includes a manual start/stop switch depressed by the expectant mother at the beginning and end, respectively, of a contraction period to initiate and terminate the periodic display of inhalation and exhalation lamps. The apparatus includes an elapsed time indicator initiated by a stop signal and halted by a start signal which measures and displays the time interval between contractions.

1 Claim, 5 Drawing Figures

FIG. 1
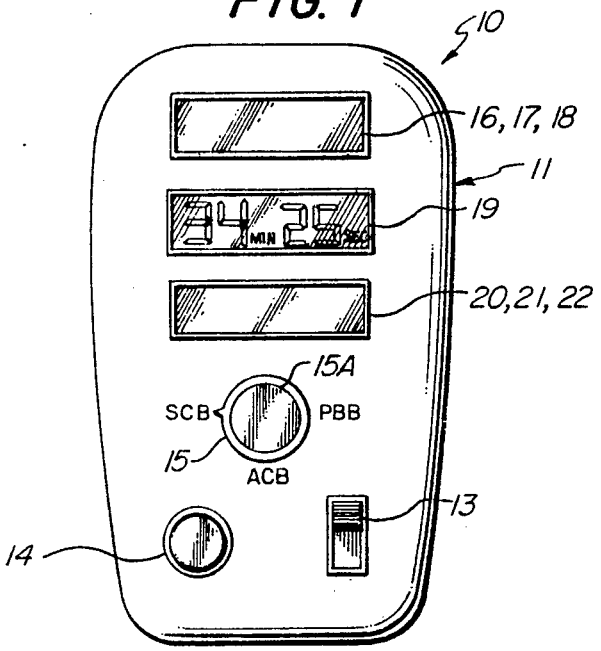
FIG. 2
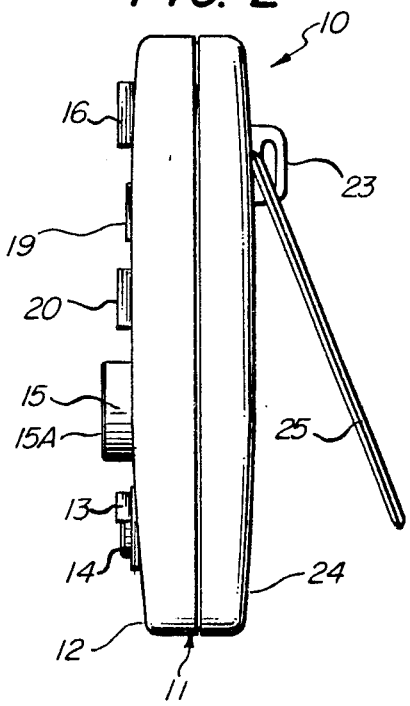
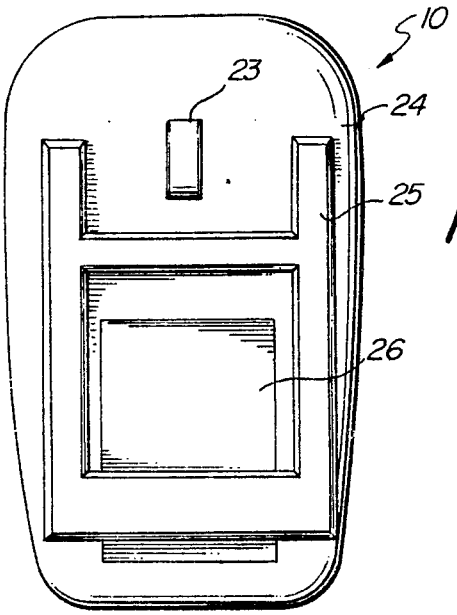
FIG. 3

CUEING AID FOR PRENATAL BREATHING CONTROL

BACKGROUND OF THE INVENTION

A. Field of the Invention

The present invention relates to apparatus for assisting pregnant women in controlling their breathing immediately prior to and during labor to minimize the pain and difficulties associated with childbirth. More particularly, the invention relates to devices for providing visual cues to a woman enabling her to adjust her breathing rate to predetermined patterns found beneficial in easing her delivery.

B. Description of Background Art

Experts in natural childbirth techniques have learned that the pain experienced by a mother during natural childbirth can be reduced by conforming her breathing to particular patterns. As the pains of labor increase in intensity, the mother must shift from a slow breathing pattern to a more rapid pattern, and finally to a third, more accelerated pattern.

The three progressively more vigorous breathing patterns described are referred to as "Slow Chest Breathing" (SCB), "Accelerated Chest Breathing" (ACB) and "Pant Blow Breathing" (PBB). Use of these breathing patterns is taught to expectant mothers in natural childbirth classes. Ideally, concentration on the recommended breathing patterns benefits not only the physiological processes of childbirth, but distracts the mother from her labor pains, thereby reducing those pains. However, the expectant mother often forgets to employ the beneficial breathing techniques when labor pains begin. Accordingly, the present invention was conceived of to assist the expectant mother in conforming her breathing pattern during labor to pre-determined patterns found useful in easing labor pains and facilitating delivery of her baby.

OBJECTS OF THE INVENTION

An object of the present invention is to provide an apparatus which provides periodic visual cues in a predetermined pattern to which an expectant mother may synchronize her respiration cycles.

Another object of the invention is to provide an apparatus capable of producing a selected one of a plurality of predetermined visual cue patterns for synchronizing respiration cycles.

Another object of the invention is to provide a visual indication of the time elapsed between prenatal contractions of an expectant mother, thereby signifying to her which one of the plurality of breathing patterns she should conform her breathing to to reduce pain and facilitate the delivery process.

Various other objects and advantages of the present invention, and its most novel features, will become apparent to those skilled in the art by reading the accompanying specification and claims.

It is to be understood that although the invention disclosed herein is fully capable of achieving the objects and providing the advantages described, the description of the invention contained herein is merely illustrative of the preferred embodiments. Accordingly, we do not intend that the scope of our exclusive rights and privileges in the invention be limited to the details of the embodiments described. We do intend that reasonable equivalents, adaptations and modifications of the various embodiments and alternate forms of the present invention which are described herein be included within the scope of this invention as particularly pointed out by the appended claims.

SUMMARY OF THE INVENTION

Briefly stated, the present invention comprehends an apparatus to assist expectant mothers during labor and delivery. The apparatus is a self-contained, electronically controlled instrument which uses periodically illuminated lamps to provide visual cues to which the mother is directed to synchronize her respiration cycles.

In the preferred embodiment, illumination of one lamp of a particular color, green for example, indicates that period during which the expectant mother should be inhaling. A second lamp, preferably of a different color, red for example, indicates by its illumination when the expectant mother should be exhaling.

The frequency and relative duration of inhalation and exhalation portions of the respiration cycle conforms to one of a plurality of pre-determined patterns selectable by a selector switch on the apparatus. Periodic, alternate illumination of inhalation and exhalation cueing lamps is initiated at the onset of contractions in the expectant mother by a first depression of a start/stop sequence button on the apparatus. This may be done by the mother herself, or by her birthing coach. Depressing the sequence button the first time also initiates operation of an electronic clock within the apparatus which measures elapsed time. When contractions cease, a second depression of the sequence button stops the illumination sequence.

At the beginning of the second contraction, the sequence button is again depressed. Depressing the sequence button a third time again initiates a periodic display of respiration cueing, alternate illumination periods of the inhalation and exhalation lamps. A third depression of the sequence button also causes the elapsed time accumulated by the electronic clock to be displayed, indicating in minutes and seconds the period of time which has elapsed between the beginning of the first contraction and the beginning of the second. Depressing the sequence button a third time also resets the clock to zero, without affecting the displayed time, and re-initiates operation of the clock.

When the second contraction has ceased, the user again pushes the sequence button, stopping the illumination cycle.

At the onset of the third contraction, the expectant mother depresses the start/stop button a fifth time, initiating once again the periodic alternate illumination of inhalation and exhalation cueing lamps, and causing the elapsed time between the beginning of the second contraction and the beginning of the third contraction to be displayed. This fifth depression of the start/stop button also resets the clock to zero, and causes the clock to once again start counting from zero while the last elapsed time interval remains displayed.

When the elapsed time between successive contractions reaches a pre-determined low value, the selection switch on the apparatus may be switched to a position causing the frequency of respiration cueing to be increased to a pre-determined value beneficial to an expectant mother who is nearing delivery. If the patterns are either too fast or too slow, the user can use a fine tune knob to adjust the speed of the patterns up to 20% in either direction.

BRIEF DESCRIPTION OF THE DRAWINGS

FIG. 1 is a front elevation view of the visual cueing aid for prenatal breath control according to the present invention.

FIG. 2 is a side elevation view of the apparatus of FIG. 1.

FIG. 3 is a rear elevation view of the apparatus of FIG. 1.

DETAILED DESCRIPTION OF THE INVENTION

Figure 4:
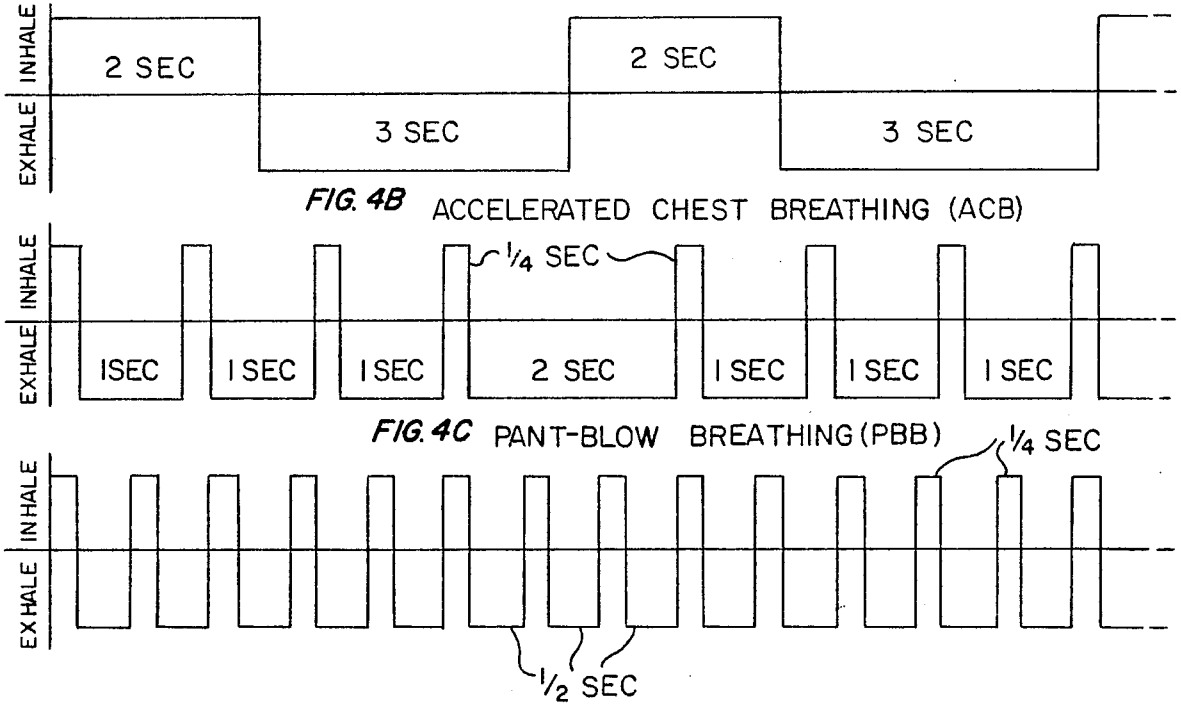
FIG. 4 is a timing diagram showing the cueing patterns producible by the apparatus of FIG. 1.

Referring now to FIGS. 1 through 3, the visual cueing aid for prenatal breath control apparatus 10 according to the present invention includes a small, generally rectangular enclosure with curved edges. Mounted through the front panel 12 of enclosure 11 are a power switch 13, a momentary contact, start/stop sequence push button switch 14, and a three position, rotary select switch 15. A frequency adjustment potentionometer and knob 15A is mounted coaxially over selector switch 15.

An elongated rectangular inhalation indicator 16 comprising an electrical lamp 17 and a colored diffusing lens 18 covering the lamp is mounted through front panel 12 of enclosure 11, parallel to and near the top edge of the enclosure. Preferably, diffusing lens 18 is colored green.

Mounted through front panel 12 of enclosure 11, immediately below and parallel to inhalation indicator 16, is an elongated rectangular digital time display unit 19. Digital time display unit 19 has provisions for displaying elapsed time in minutes and seconds by means of energized light emitting diodes (LED's), liquid crystal display (LCD) elements, or other electrically operable display elements.

An exhalation indicator 20 similar in size and shape to inhalation indicator 16 is mounted through front panel 12 of enclosure 11 in parallel alignment with the inhalation indicator. Exhalation indicator 20 includes an electrical lamp 21 covered by a colored diffusing lens 22. Preferably, exhalation diffusing lens 22 is of a different color than diffusing lens 18 for inhalation indicator 16. A suitable choice for the color of exhalation diffusing lens 22 is red.

As may be seen best by referring to FIGS. 2 and 3, an eye bolt 23 projects outward from the rear panel of enclosure 11, near the top wall of the enclosure. Eye bolt 23 is provided to accommodate a cord or lanyard which may be looped around the neck of the expectant mother or her coach, suspending apparatus 10 in a position conveniently viewable by the expectant mother.

As may be seen best by referring to FIGS. 2 and 3, apparatus 10 includes a stand 25 which may be pivoted outward from the rear panel 24 of enclosure 11, allowing the apparatus to be propped up in an upright, easily readable position on the horizontal surface of a bedstand or other piece of furniture.

A rectangular battery access panel 26 is mounted on rear panel 24 of enclosure 11, flush with the rear surface of the rear panel. Battery access panel 26 is contained within a rectangular well, and may be slid downward to permit the panel to be pivoted rearward from the rear panel, providing access to the interior of enclosure 11 for replacing battery 27.

Figure 5:
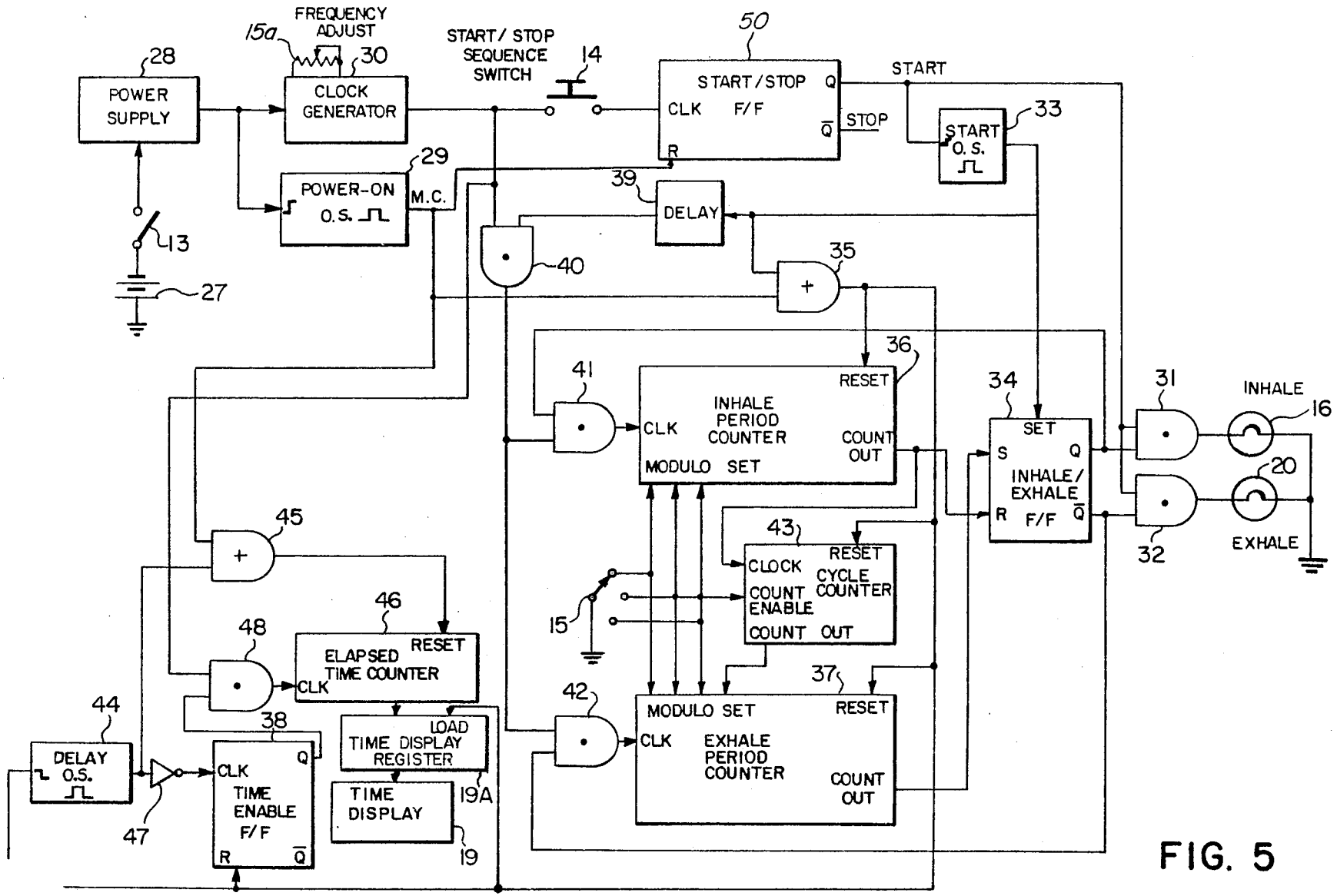
FIG. 5 is a block diagram of the electrical system of the apparatus of FIG. 1.

FIG. 5 is a simplified block diagram showing the interconnection of the various functional components of apparatus 10. Preferably, the functional electronic components shown in FIG. 5 are integrated circuits. Those skilled in the art of logic design employing integrated circuits will recognize that the implementation of the logical functions of the apparatus according to the present invention may be made in a variety of ways as a matter of ordinary design choice, without departing from the spirit of the invention. For example, a NAND gate in series with an inverting gate can be used in place of an AND gate, and a plurality of multiplexed counters of fixed modulo may be substituted for a variable modulo counter. Also, the entire control and timing functions of the apparatus could be performed by a microprocessor.

Referring now to FIG. 5, the visual cueing aid for prenatal breath control 10 according to the present invention is put into an operational mode by turning on power switch 13, thereby connecting internal battery 27 to power supply 28. Power supply 28 provides at its output terminal a fixed regulated voltage for operation of the other electronic components of the apparatus in spite of variations in the output voltage of battery 27.

The output terminal of power supply 28 is connected to the power input terminals of each of the active electronic components of the apparatus, including power-on one-shot 29. Power-on one-shot 29 is a monostable multivibrator which produces at its output terminal a single, brief master clear (m.c.) pulse when power is applied to its input terminal. The m.c. pulse is used to clear various counters and reset various flip-flops of the apparatus for a brief moment after power switch 13 is turned on.

Clock generator 30 of apparatus 10 is a free-running oscillator which produces a timing signal or clock pulse train, preferably in the form of a square wave having a 50% duty cycle. The clock signal is used by various components in apparatus 10, in a manner to be described. The frequency of clock generator 30 may be varied ±20% by user-controlled frequency adjustment potentionmeter and knob 15A.

After apparatus 10 has been placed in an operational mode by turning on power switch 13, a cyclical, alternate display of inhalation cueing and exhalation cueing indicators 16 and 20 is initiated by a first depression of start/stop switch 14. Depressing start/stop switch a first time after power has been turned on couples the clock signal from clock generator 30 to the clock input terminal of start/stop flip-flop 50. The clock signal sets flip-flop 50, which was placed in a reset state by the power-on reset pulse (m.c.). A logic true output at the set or Q output terminal of start/stop flip-flop 50 enables inhale lamp driver enable AND gate 31 and exhale lamp driver enable AND gate 32, each of those gates having one input terminal connected to the Q output terminal of the flip-flop.

The Q output terminal of start/stop flip-flop 30 is also connected to a start one-shot 33, which produces a short initializing pulse at the start of an illumination cycle. The initialize pulse at the output terminal of one-shot 33 is connected to a set input terminal of inhale/exhale flip-flop 34, causing the Q output terminal of the flip-flop to go to a logic true level and the $\overline{Q}$ output to go to a logic false level. Since a second input terminal of inhale lamp driver enable AND gate 31 is connected to the Q output terminal of inhale/exhale flip-flop 34, and the second input terminal of the AND gate is at a logic true level by virtue of its being connected to the Q output terminal of the start/stop flip-flop 30, setting inhale/exhale flip-flop 34 causes the output terminal of AND gate 31 to go to a true level, thereby illuminating inhale lamp 16 connected to the output terminal of the AND gate. Conversely, the output terminal of AND gate 32, which has an input terminal connected to the $\overline{Q}$ output terminal of inhale/exhale flip-flop 34, remains at a false level, maintaining exhale lamp 20 connected to the output terminal of the AND gate at a dark level.

The output terminal of start one-shot 33 is also connected to an input terminal of OR gate 35, the other input of the OR gate being connected to the output terminal of power-on one-shot 29. Thus, a pulse is produced at the output terminal of OR gate 35 when power is first turned on or when start/stop flip-flop 50 is set, recalling that setting flip-flop 50 cause start one-shot 33 to produce a short initializing pulse.

Now, since the output terminal of OR gate 35 is connected to the reset input terminals of inhale period counter 36 and exhale period counter 37, these counters are cleared to a zero count when power is turned on or an illumination cycle is initiated. In the same manner, timer enable flip-flop 38, which has a reset input terminal connected to the output terminal of OR gate 35, is reset at power turn on or at the initiation of an illumination cycle.

Inhale period counter 36 and exhale period counter 37 are binary counters of variable modulo. The modulo of each of these counters is separately adjustable by means of mode select switch 15 connected to modulo-setting input terminals of the counter. The operation of these counters will now be described.

As shown in FIG. 5, the output terminal of start one-shot 33 is connected to the input terminal of signal delay element 39. The output terminal of signal delay element 39 is connected to one input of clock enable AND gate 40. A second input terminal of clock enable AND gate 40 is connected to the output terminal of clock generator 30. The function of signal delay element 39 is to delay the appearance of clock pulses at the output of clock enable AND gate 40 for a period sufficient to allow the resetting of inhale period counter 36 and exhale period counter 37.

After a delay period controlled by delay element 39, clock pulses appear at the output terminal of clock enable AND gate 40. The output terminal of the clock enable AND gate is connected to an input terminal of inhale count enable AND gate 41 and to an input terminal of exhale count enable AND gate 42. A second input of inhale count enable AND gate 41 is connected to the Q output terminal of inhale/exhale flip-flop 34, and a second input terminal of exhale count enable AND gate 42 is connected to the $\overline{Q}$ output terminal of the inhale/exhale flip-flop. Therefore, since inhale/exhale flip-flop 34 is initially set during the beginning of an illumination cycle, inhale period counter 36, which has its clock input terminal connected to the output terminal of inhale count enable AND gate 41, begins to count at the end of the delay period imposed by delay element 39. Moreover, since inhale period counter 36 is cleared to a zero count during initialization, the count increments from zero.

When the count in inhale period counter 36 accumulates to a value determined by mode select switch 15, a pulse appears at the count output terminal of the counter. Since the count output terminal of inhale period counter 36 is connected to the reset input terminal of inhale/exhale flip-flop 34, the inhale count output pulse resets the flip-flop. Resetting inhale/exhale flip-flop 34 extinguishes inhale lamp 16 and illuminates exhale lamp 20. The resetting of flip-flop 34 also disables inhale count enable AND gate 41 and enables exhale count enable AND gate 42.

In an exactly analogous fashion, accumulation of a pre-determined count value in exhale period counter 37 sets inhale/exhale flip-flop 34, extinguishes exhale lamp 20, illuminates inhale lamp 16, and enables inhale count enable AND gate 41 to begin a new cycle of counting by inhalation counter 36. Thus, the cyclical, alternate pattern of inhalation and exhalation indicator illuminations shown diagrammatically in FIGS. 4A and 4C is continued as long as start/stop flip-flop 30 remains in a set condition.

The system including an inhale period counter and exhale period counter just described is capable of producing cyclic patterns of inhalation and exhalation cueing indicator illuminations in which the inhalation and exhalation periods are constant. For example, with selector switch 15 set to position 1 "Slow Chest Breathing," the pattern of illumination cycles shown in FIG. 4A is generated. In this pattern, the time history of illumination cycles consists of a 2-second inhalation indicator illumination followed by a 3-second exhalation indicator illumination. This pattern is repeated indefinitely as long as start/stop flip-flop 50 is set, producing the rectangular waveform of constant duty cycle shown in FIG. 4A.

Similarly, setting selector switch 15 to position 3, "Pant-Blow Breathing," produces the constant duty-cycle illuminator waveform shown in FIG. 4C, in which a $\frac{1}{4}$ second inhalation period is followed by a $\frac{1}{2}$ second exhalation period.

When selector switch 15 is set to position 2 to command the "Accelerated Chest Breathing" mode, the commanded waveform is no longer a constant duty cycle waveform. As shown in FIG. 4B, the Accelerated Chest Breathing pattern consists of an inhalation period of $\frac{1}{4}$ second followed by an exhalation period of 1 second repeated for three cycles, followed by an exhalation period of 2 seconds, and then a repetition of the three cycles. Thus, the exhalation period, and hence the duty cycle of the breathing waveform, must be altered every three cycles. The required change in the duration of the exhalation period every 3 cycles is accomplished by means of cycle counter 43. Cycle counter 43, which is enabled only when selector switch 15 is set to position 2, "Accelerated Chest Breathing", produces an output pulse every 3 cycles which is coupled to a fourth modulo-setting input terminal of exhale period counter 37, thus altering the exhale period every three cycles, as required.

When start/stop sequence switch 14 is actuated the first time, a pulse is produced at the output of OR gate 35 as has been described above. Since the output terminal of OR gate 35 is connected to the reset input terminal of timer enable flip-flop 38, this flip-flop is reset at the beginning of an illumination sequence. The pulse at the output of OR gate 35 is also coupled to the load input terminal of time display register 19A. This transfers the contents of elapsed time counter 46, which was cleared to zero by the m.c. pulse, into time display register 19A. The output port of time display register 19 is connected to the input port of time display unit 19, thereby displaying the contents of the register on the time display unit.

The output terminal of OR gate 35 is also connected to the input terminal of delay one-shot 44. Delay one-shot 44 is responsive to a negative logic level transition on its input terminal in producing a positive-going output pulse. Therefore, a positive-going output pulse is produced at the output terminal of delay one-shot 44 at the end of the positive-going pulse at the output of OR gate 35. The positive-going pulse at the output terminal of delay one-shot 44 is conducted through OR gate 45 to the reset input terminal of elapsed time counter 46. Thus, elapsed time counter 46 is cleared after its contents have been loaded into time display register 19A at the beginning of the positive-going pulse appearing at the output terminal of OR gate 35.

The output terminal of one-shot 44 is also connected to the input terminal of inverter 47, producing a negative going pulse at the output terminal of the inverter, which is connected to the clock input terminal of timer enable flip-flop 38. Timer enable flip-flop 38 is responsive to a positive transition of a clock input pulse and is therefore set at the end of the one-shot period. At this time, AND gate 48, which has one of its two input terminals connected to the Q output terminal of timer enable flip-flop 38, permits clock generator pulses appearing at its other input terminal to be coupled to the clock input terminal of elapsed time counter 46, which terminal is connected to the output terminal of the AND gate. Thus, after a brief delay for the period of the output pulse of delay one-shot 44 during which elapsed time counter 46 is reset and timer enable flip-flop 38 is set, the elapsed time counter begins to increment a count in minutes and seconds.

When start/stop sequence switch 14 is depressed a second time, after the end of the expectant mother's first contraction, start/stop flip-flop 50 is reset. Since lamp enable AND gates 31 and 32 each have an imput terminal connected to the Q output terminal of start/stop flip-flop 50, resetting that flip-flop disables illumination lamps 16 and 20.

Start/stop switch 14 is depressed a third time, at the time the expectant mother begins experiencing a second contraction. This causes start/stop flip-flop 50 to be set a second time, producing a pulse at the output of OR gate 35 which is coupled to the reset input terminal of timer enable flip-flop 38, resetting the flip-flop and disabling further clock pulses from being inputted to elapsed time counter 46. With no clock pulses being inputted to elapsed time counter 46, the count remains fixed and is displayed via time display unit 19 as the time which has elapsed between the beginning of the previous contraction, marked by the previous first or odd depression of the start/stop sequence button 14, and the beginning of the second contraction, marked by the third, or odd depression of the start/stop sequence button.

When push button start/stop switch 14 is depressed a fourth, or even time, the illumination display sequence is halted, while elapsed time counter 46 is enabled to count as described above.

Those skilled in the art will recognize that the novel function of the apparatus according to the present invention could be implemented in alternate ways without departing from the spirit of the invention. For example, a microprocessor could be used to produce the cueing illumination cycles and measurement of time elapsed between contractions.

Audible cues could be used in addition to the visual cues, as for example, for blind expectant mothers. Audible cueing could easily be accomplished by paralleling or replacing the visual inhalation indicator with an audible tone generator of a particular frequency, and paralleling or replacing the visual exhalation indicator with an audible tone, of a different frequency. Furthermore, a voice synthesizer producing the words "In", "Out" or "Inhale", "Exhale" at the appropriate times could be used in place of or in addition to the visual inhalation/exhalation indicators without departing from the spirit of the invention.

What we claim is:

1. An apparatus for producing sensory cues for use by an expectant mother to synchronize her breathing to comprising:

(a) first electrically energizable cueing means for producing a first sensory cue;

(b) second electrically energizable cueing means for producing a second sensory cue;

(c) electronic sequencer means for cyclically and alternately energizing said first and second cueing means, said sequencer means being capable of producing a plurality of manually selectable time patterns of cyclical and alternate energization of said first and second cueing means, at least one of which said time patterns having a duty cycle which varies automatically in a pre-determined fashion;

(d) means for manually selecting a desired one of said plurality of patterns;

(e) means for manually starting and stopping said sequence of alternate energization of said first and second cueing means; and (f) counter means for measuring and displaying the elapsed time between successive starting actuations of said starting and stopping means, said counter means including a counter responsive to first and successive odd actuations of said manual starting and stopping means in (i) displaying an accumulated count proportional to elapsed time, (ii) clearing said counter to zero, and (iii) accumulating a new count proportional to elapsed time.

* * * * *